United States Patent [19]

Kinsley

[11] Patent Number: 4,779,766

[45] Date of Patent: Oct. 25, 1988

[54] DISPENSING CLOSURE FOR A CONTAINER

[75] Inventor: John P. Kinsley, Crystal Lake, Ill.

[73] Assignee: Seaquist Closures, Crystal Lake, Ill.

[21] Appl. No.: 14,470

[22] Filed: Feb. 13, 1987

[51] Int. Cl.[4] ..... B67B 5/00; B67D 3/00

[52] U.S. Cl. ..... 222/153; 222/481.5; 222/484; 222/541; 222/543; 222/546; 220/254; 220/307

[58] Field of Search ..... 222/153, 541, 479, 484, 222/546, 543, 151, 480, 482, 483, 478, 481.5; 220/254, 260, 266, 270, 307

[56] References Cited

U.S. PATENT DOCUMENTS

| | | | |
|---|---|---|---|
| 2,314,167 | 3/1943 | Shaw | 222/484 X |
| 2,838,768 | 6/1958 | Fischett | 4/507 |
| 2,881,936 | 4/1959 | Piker | 215/13 R |
| 2,889,089 | 6/1959 | Herrick | 222/540 |
| 2,991,913 | 7/1961 | Goth | 222/153 |
| 3,059,816 | 10/1962 | Goldstein | 222/546 |
| 3,101,878 | 8/1963 | Bee | 222/542 |
| 3,117,701 | 1/1964 | Stull | 222/543 |
| 3,204,829 | 9/1965 | Song | 222/153 |
| 3,235,147 | 2/1966 | Hamilton | 222/543 |
| 3,251,509 | 5/1966 | Foster | 222/153 |
| 3,255,928 | 6/1966 | Foster | 222/153 |
| 3,282,478 | 11/1966 | Russell | 222/542 |
| 3,369,718 | 2/1968 | Libit et al. | 222/481.5 |
| 3,419,198 | 12/1968 | Petersen | 222/541 |
| 3,465,925 | 9/1969 | Bertolli | 222/536 |
| 3,493,150 | 2/1970 | Lucas et al. | 222/480 |
| 4,163,496 | 8/1979 | Dogliotti . | |
| 4,291,818 | 9/1981 | Nozawa et al. . | |
| 4,343,397 | 8/1982 | Nozawa et al. . | |
| 4,344,545 | 8/1982 | Aschberger et al. | 220/307 |
| 4,369,901 | 1/1983 | Hidding . | |
| 4,615,462 | 10/1986 | Sacherer et al. . | |

FOREIGN PATENT DOCUMENTS

| | | | |
|---|---|---|---|
| 1475639 | 7/1965 | France | 222/541 |

*Primary Examiner*—Joseph J. Rolla
*Assistant Examiner*—Stephen B. Parker
*Attorney, Agent, or Firm*—Dressler, Goldsmith, Shore, Sutker & Milnamow, Ltd.

[57] ABSTRACT

A dispensing closure is provided with a body portion and a strap connected to the body portion. The strap includes a plug for occluding a dispensing hole in the closure body portion and may include a projection for anchoring the strap to the closure body portion through another hole. A vent tube may be provided through the anchoring projection. For providing tamper indication, an orifice-defining anchor portion may be mounted in the dispensing hole of the closure body portion and connected via a frangible web to a retaining member overlying a portion of the strap.

8 Claims, 3 Drawing Sheets

FIG. 1
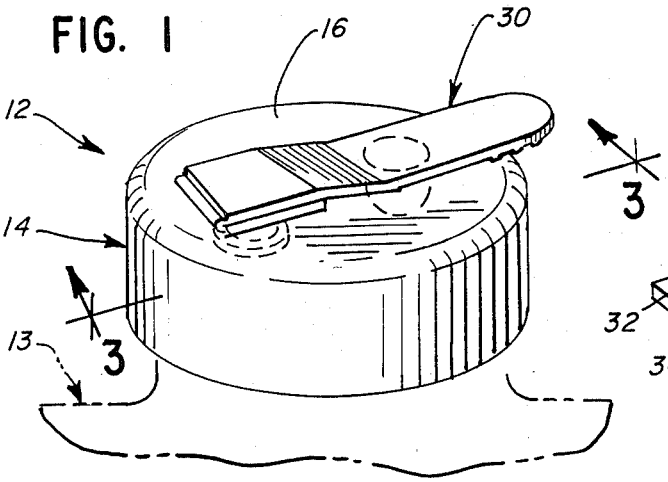
FIG. 2
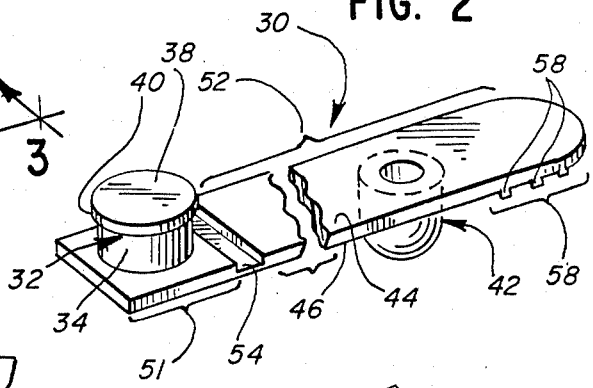
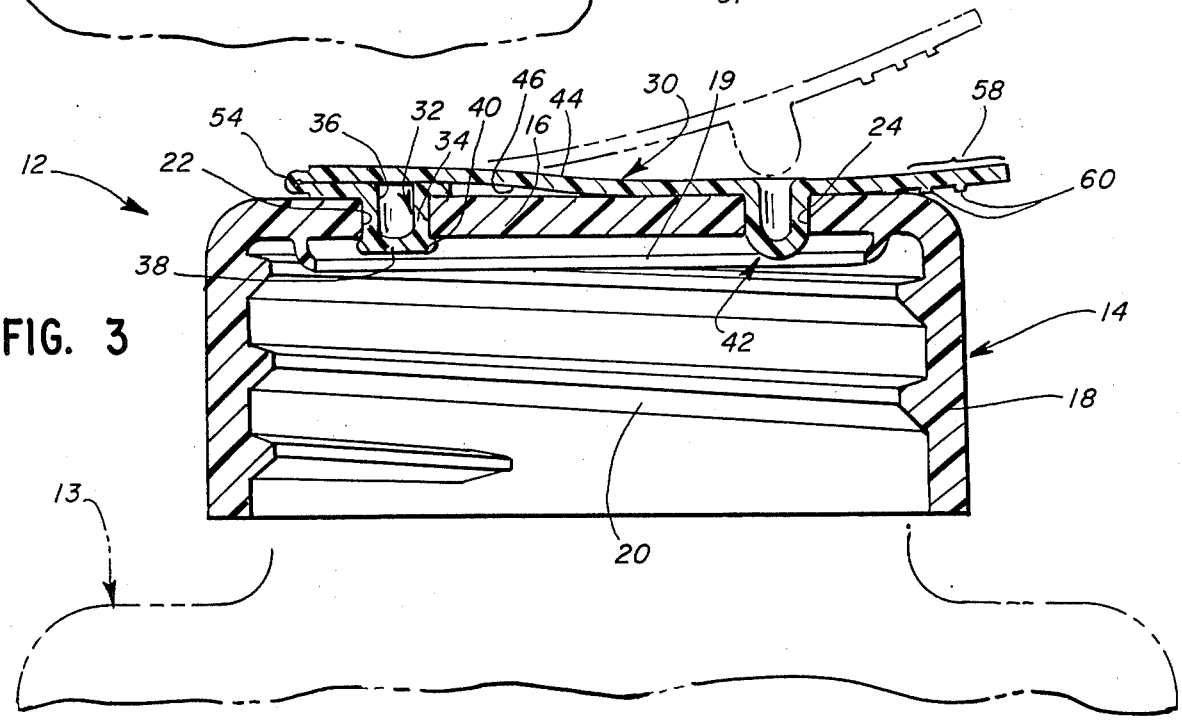
FIG. 3
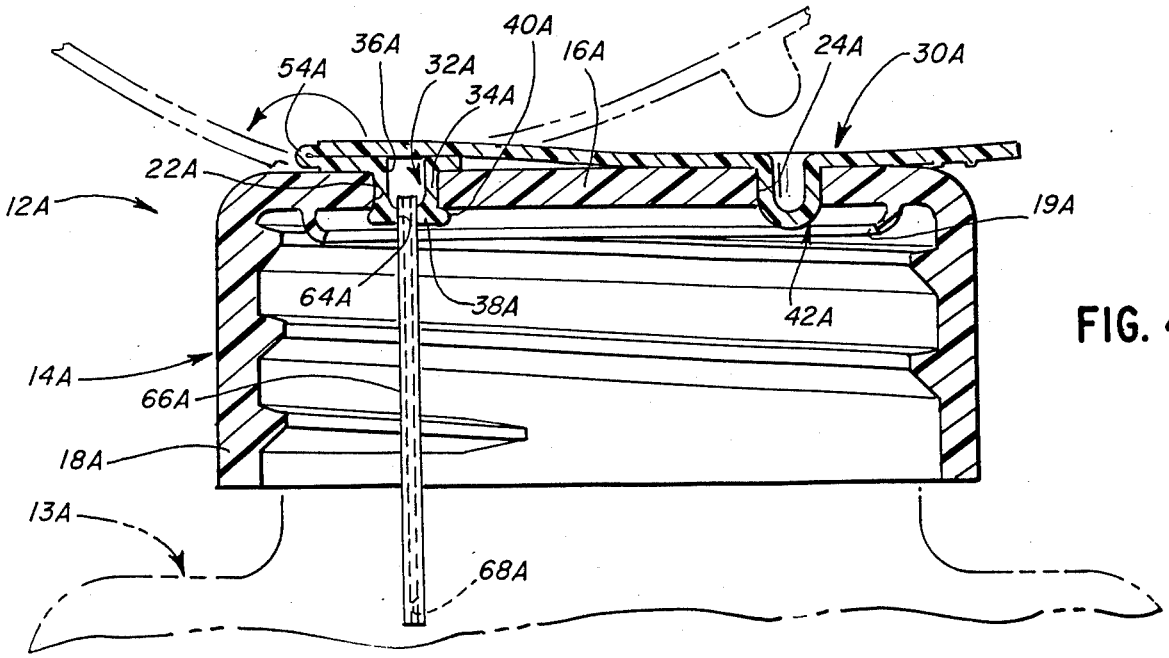
FIG. 4

FIG. 5
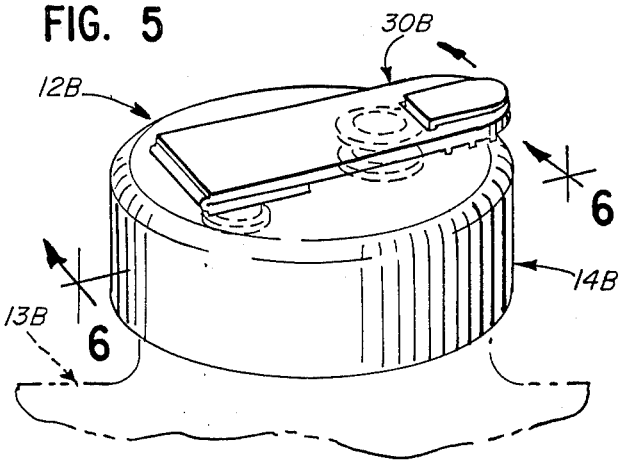
FIG. 7
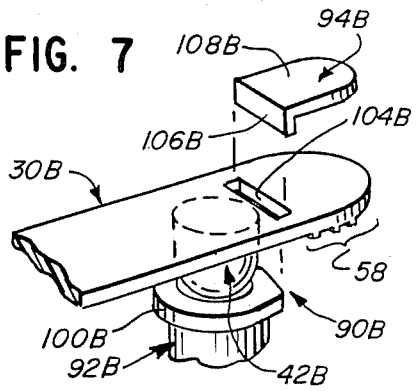
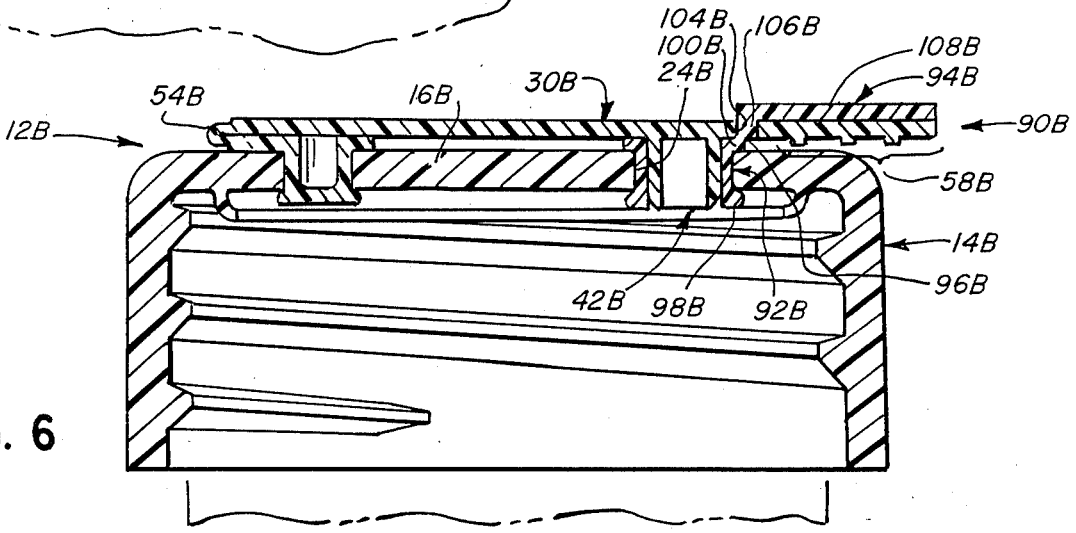
FIG. 6
FIG. 8
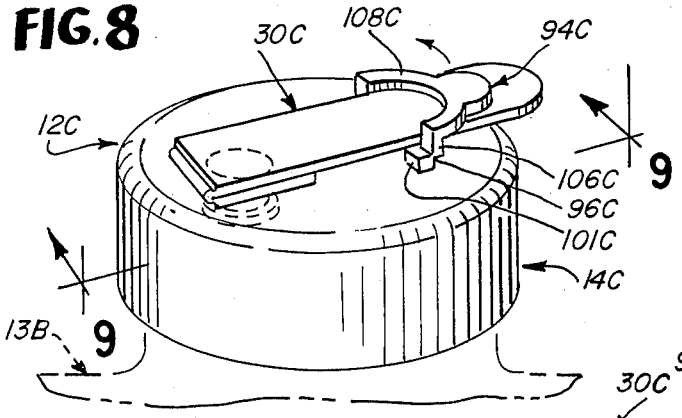
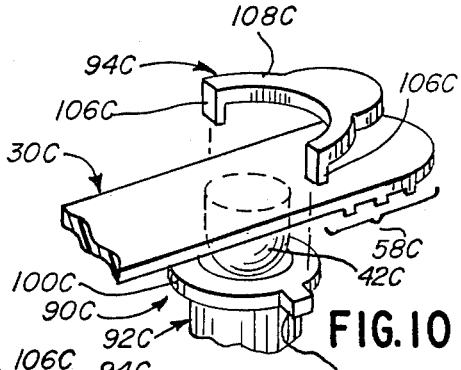
FIG. 10
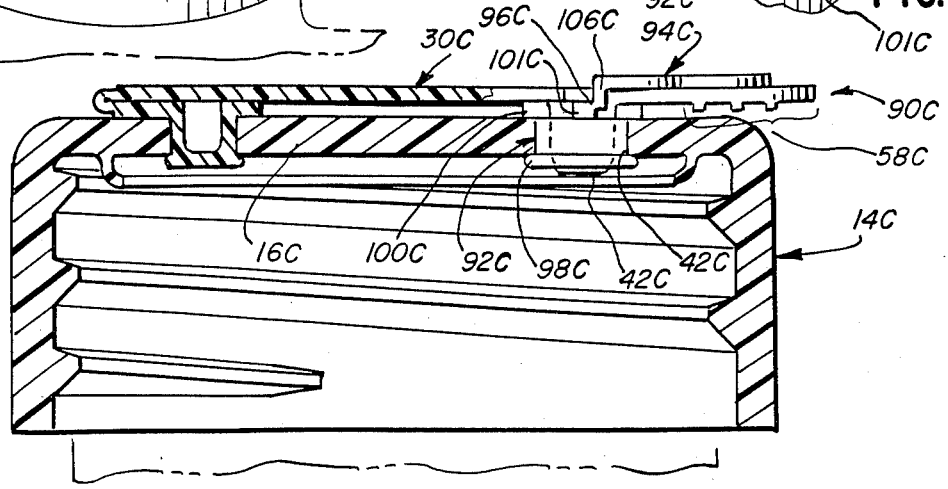
FIG. 9

DISPENSING CLOSURE FOR A CONTAINER

TECHNICAL FIELD

This invention relates to closures for containers, and more particularly to a closure which includes an opening for dispensing the container contents through the closure and means for sealing the dispensing opening.

BACKGROUND OF THE INVENTION AND TECHNICAL PROBLEMS POSED BY THE PRIOR ART

Designs have been proposed for providing container closures with dispensing openings. Typically, such conventional designs require the use of a special closure specifically designed to provide a dispensing orifice or spout and to provide suitable orifice sealing means.

It would be desirable to provide a dispensing and sealing structure which could be relatively inexpensively incorporated in conventional closures with a minimum of modification.

It would also be beneficial if such an improved design could accommodate venting of the container to facilitate steady stream dispensing or pouring of the container contents.

It would also be advantageous if such an improved dispensing and sealing structure could be provided with tamper-indicating or tamper-evident means for showing when the dispensing orifice has been opened, and it would be beneficial if such a tamper-evident means could be relatively easily incorporated on conventional closures.

SUMMARY OF THE INVENTION

A dispensing closure is provided for the mouth of a container. The closure includes a body portion for being mounted to the container across the mouth of the container. The body portion may be a conventional snap-on or threaded cap type closure relatively easily modified by providing two clear-through holes.

A strap is provided with a first projection anchored and retained in one of the holes. The strap has a second projection or plug which is removably positioned in the other hole to seal the other hole.

A finger grip tab may be provided on the strap to extend beyond the second projection. This can be used to easily lift the second projection out of the hole to permit discharging the contents of the container through the open hole.

The first projection which is anchored and retained in the first hole may include a vent tube communicating between the interior of the closure and the exterior of the closure. With this added feature, the strap is folded over on itself to seal the vent through the first hole while positioning the second projection in the second hole.

The folded strap configuration also provides a natural biased hinging action that serves to keep the second projection clear of the second (dispensing) hole after the second projection has been disengaged from the second hole.

Another aspect of the invention provides tamper-evident means for indicating when the strap has been lifted up to remove the projection from the dispensing hole. To this end, the strap is connected to the closure body portion to permit movement of a length of the strap toward and away from the closure body portion. One such connection structure may include the above-discussed projection means for anchoring the strap in a hole in the closure body portion. A frangible tamper-evident means is anchored to the closure body portion and overlies a portion of the strap. When the strap is lifted up to open the dispensing hole, the frangible tamper-evident means is severed.

In a preferred embodiment of the tamper-evident feature, a special anchor portion is disposed in the closure body portion dispensing hole. The anchor member is a spool-shaped annular member that defines a dispensing orifice which can be sealed by a projection or plug on the strap. A retaining member is connected via a frangible web to the special anchor portion and extends over a portion of the strap.

Numerous other features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of one type of a conventional closure converted to a dispensing closure in accordance with the teachings of the present invention.

FIG. 2 is an enlarged, fragmentary, perspective view of the closure strap as provided in accordance with the teachings of the present invention, the strap being shown in an unfolded orientation disassembled from the closure body portion;

FIG. 3 is a greatly enlarged, cross-sectional view taken generally along the plane 3—3 in FIG. 1 and showing the strap in solid line closing the dispensing hole and showing the strap in dashed line in a moved position wherein the dispensing hole is opened;

FIG. 4 is a view similar to FIG. 3 but showing a second embodiment of the closure;

FIG. 5 is a perspective view similar to FIG. 1 but showing another embodiment of the present invention wherein a tamper-evident feature is provided;

FIG. 6 is a greatly enlarged, cross-sectional view taken generally along the plane 6—6 in FIG. 5;

FIG. 7 is a fragmentary, exploded, perspective view of a portion of the closure illustrated in FIGS. 5 and 6 to better illustrate the details of the taper-evident construction;

FIG. 8 is a view similar to FIG. 5 but showing another embodiment of the present invention with another form of the tamper-evident feature;

FIG. 9 is a greatly enlarged, cross-sectional view taken generally along the plane 9—9 in FIG. 8;

FIG. 10 is a view similar to FIG. 7 but showing the modified form of the tamper-evident structure illustrated in FIGS. 8 and 9;

DESCRIPTION OF THE PREFERRED EMBODIMENTS

Figure 11:
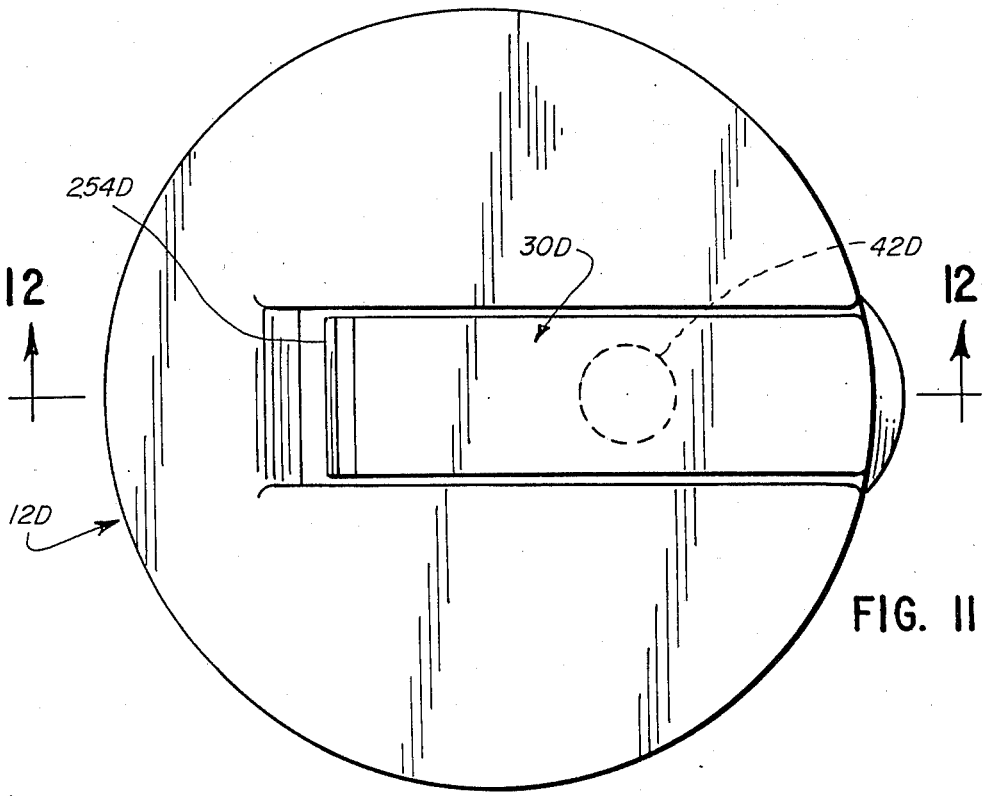
FIG. 11 is a top plan view of yet another embodiment of the present invention.

While this invention is susceptible of embodiment in many different forms, this specification and the accompanying drawings disclose only some specific forms as examples of the use of the invention. The invention is not intended to be limited to the embodiments so described and the scope of the invention will be pointed out in the appended claims.

For ease of description, the closure of the invention is described in a position as it is usually encountered—on top of an upright container, and terms such as upper, lower, horizontal, etc., are used with reference to this position. It will be understood, however, that the closure of this invention may be manufactured, stored, transported, used, and sold in an orientation other than the position described.

A first embodiment of the dispensing closure of the present invention is illustrated in FIGS. 1–3 wherein the closure is represented generally by the reference numeral 12. The closure 12 is adapted to be mounted on a container 13 (a portion of which is illustrated in FIGS. 1 and 3 in dashed lines) which may have a conventional open mouth defined by a neck or other suitable structure.

As best illustrated in FIG. 3, the closure 12 includes means for securement to the container 13. In the illustrated embodiment, the closure 12 includes a base, body portion, or mounting portion 14, and this portion 14 has a generally disc-like, transverse or top closure wall 16 and a generally peripheral wall or skirt 18.

As best illustrated in FIG. 3, the skirt 18 includes, on its interior surface, threads 20 or other suitable means (e.g., snap-fit beads or other snap-on or bayonet-type mounting means) for engaging suitable cooperating means on the container 13 to releasably secure the closure 12 on the container.

An annular sealing ring 19 may be provided, as best illustrated in FIG. 3, for engaging the interior portion of the container mouth for effecting a tight seal.

In accordance with the teachings of the present invention, a conventional closure body portion 14 may be relatively easily modified to provide a dispensing orifice and sealing structure. Typically, a conventional closure would have a solid top wall 16. In accordance with the teachings of the present invention, such a conventional closure may be modified by forming one or more openings in the top wall and adding a novel sealing structure as described in detail hereinafter.

A first hole 22 and a second hole 24 are provided in the top wall 16 of the closure body portion 14 as best illustrated in FIG. 3. In the preferred embodiment illustrated, each hole is a generally cylindrical bore extending clear through the top wall 16. The hole 24 functions as a dispensing orifice or opening for permitting discharge of the container contents through the closure 12 when the hole 24 is open. The hole 22 serves as a means by which a novel strap is anchored to the closure body portion 14.

The strap 30 is a generally elongate member that is preferably flexible over most of its length. The strap 30 has a first projection or anchor projection means 32 which is interlocked in the closure body portion 14 through the hole 22. The first projection 32 has an annular wall 34 that defines a cylindrical interior bore 36. The projection 32 also includes a crosswall 38 occluding the cylindrical interior bore 36. The projection 32 further includes an annular flange 40 which lies against the underside of the closure body portion top wall 16 and prevents the strap 30 from being pulled out of the top wall 16 under normal use conditions.

The projection 32 may be inserted into the top wall 16 during manufacture by using enough force to compress the projection 32 radially inwardly by an amount sufficient to allow it to snap into place within the first hole 22. To this end, the projection 32, along with the remaining portion of the strap 30, may be conveniently fabricated from a suitable thermoplastic material.

The strap 30 is also provided with a second projection or plug 42 as best illustrated in FIG. 3, and the plug 42 is adapted to be removably positioned in the second hole 24 to seal the second hole 24.

In the preferred embodiment of the invention illustrated in FIGS. 1–3, the strap 30 has a unique configuration. Specifically, with reference to FIG. 2 showing the strap 30 in its unassembled configuration, the strap 30 has an upwardly facing side surface 44 and a downwardly facing side surface 46. The first projection 32 extends upwardly from the side surface 44, and the second projection or plug 42 extends downwardly from the side surface 46.

The strap 30 also includes a first segment 51 which contains the first projection (anchor projection means) 32 and a second segment 52 which contains the second projection or plug 42. The first and second strap segments are connected together by a hinge 54. In the preferred embodiment illustrated, the hinge 54 is a flexible hinge formed from a reduced thickness section of the strap 30.

The strap 30 may be readily installed on a conventional, solid top closure. To this end, the two holes 22 and 24 are simply punched or drilled in the closure top wall 16.

The strap 30 is installed on the closure body portion 14 by folding the first segment 51 and the second segment 52 about the hinge 54 and then inserting the first projection 32 into the top wall first opening 22 as illustrated in FIG. 3. The second segment 52 of the strap 30 is thus movable toward and away from the closure body portion top wall 16 as it pivots about the hinge 54. The plug 42 may thus be moved into or out of the hole 24.

The folded strap configuration also provides a natural biased hinging action that serves to keep the plug 42 clear of the hole 24 after the plug has been disengaged from the hole.

Preferably, the second segment 52 of the strap 30 extends beyond the plug 42 to define a finger grip tab 58. The tab 58 may be provided with ridges 60 on the bottom surface 46 of the strap 30, and the finger grip tab 58 may also extend beyond the circumferential periphery of the closure body portion 14 so as to facilitate grasping of the tab 58.

It is to be realized that, although the strap 30 is illustrated as having a hinge 54 and a folded-over segment 51 for being anchored to the closure body portion 14, other configurations will be apparent to those skilled in the art, and the scope of the invention with respect to attachment of the strap 30 to the closure body portion 14 is set forth in the claims.

A second embodiment of the closure is illustrated in FIG. 4 and is designated generally by the reference numeral 12A. The closure 12A includes many elements which are identical or functionally analogous to those of the first embodiment of the closure 12 and which are designated by reference numerals identical to those used for the first embodiment with the exception that the second In the second embodiment, the second projection 32A is anchored in the closure body portion top wall 16 in the same manner as described above for the first embodiment. However, the second projection 32A includes an aperture 64A in the crosswall 38A. The aperture 64A communicates with the interior of the closure 12A and receives a hollow vent tube 66A. The tube 66A may be mounted in press fit engagement with the cross-wall 38A and/or may be adhesively secured thereto or formed integrally therewith.

The vent tube 66A extends downwardly below the closure top wall 16A and has an internal passage 68A which provides communication through the first projection 32A to the exterior of the closure top wall 16A. However, this passage 68A is effectively sealed when the second segment of the strap 30A is folded over on top of the first segment for sealing the second hole 24A with the second projection 42A.

When the strap 30A is lifted upwardly to open the dispensing hole 24A, communication is also established through the vent tube 66A between the container interior and the exterior of the container. This permits the ingress of air to maintain ambient pressure within the container so that the contents may be discharged in a steady stream.

The unique strap 30 or 30A, or variants thereof, may be provided on a closure in conjunction with a tamper-indicating or tamper-evident feature. FIGS. 5–7 illustrate one embodiment of a closure with a tamper-evident feature. The embodiment illustrated in FIGS. 5–7 includes elements that are identical or functionally analogous to those of the first embodiment discussed abovae with reference to FIGS. 1–3. These identical or functionally analogous elements are designated by reference numerals identical to those used for the first embodiment with the exception that the third embodiment reference numerals are followed by the upper case letter B.

The closure 12B includes a strap 30B which may be connected by suitable means to the closure body portion 14B to permit movement of a length of the strap 30B toward and away from the closure body portion 14B. In the embodiment illustrated in FIGS. 5–7, the strap 30B is anchored to the closure body portion 14B in the same manner as described above for the strap 30 in the first embodiment illustrated in FIGS. 1–3.

A frangible tamper-evident means 90B is anchored to the closure body portion 14B and overlies a portion of the strap 30B. The frangible tamper-evident means 90B includes an anchor portion 92B which is mounted in the closure body portion 14 below the strap 30B.

As best illustrated in FIGS. 6 and 7, the anchor portion 92B is a spool-shaped annular member having a flange 98B on the bottom end and flange 100B on the upper end. The flanges 98B and 100B retain the anchor portion 92B in the top wall 16B of the closure body portion 14B. The spool-shaped annular portion 92B has a hollow interior or bore that defines a dispensing orifice through which the container contents can be discharged.

The tamper-evident means 90B also includes a retaining member 94B which overlies the finger grip tab 58B of the strap 30B., A frangible web 96B connects the anchor portion 92B with the retaining member 94B.

The finger grip tab 58B defines a slot 104B (FIG. 7) above the frangible web 96B. The retaining member 94B has a first portion 106B which extends upwardly from the frangible web 96B and through the tab slot 104B. The first portion 106B is connected to a second portion 108B. The second portion 108B is preferably unitary with the first portion 106B and extends parallel to, and on top of, the strap finger grip tab 58B.

During fabrication of the closure with the tamper-evident means 90B, the retaining member 94B of the tamper-evident means 90B is first slipped through the slot 104B of the strap 30B, and the plug 42B is inserted into the anchor portion 92B of the tamper-evident means 90B. The anchor portion 92B, along with the engaged strap 30B, is then forced into the opening 24B of the closure body portion 14B. The anchor portion 92B and plug 42B compress radially inwardly to accommodate the insertion. To further facilitate the insertion, the plug 42B is preferably fabricated as an annular wall having a hollow interior as illustrated in FIG. 6. This accommodates the inward compression of the anchor portion 92B during insertion into the closure body portion 14B.

It can be seen that when a person attempts to open the closure 12B by lifting the strap 30B, the retaining member 94B of the tamper-evident means 90B will be lifted also. The retaining member 94B will be severed or torn away from the anchor portion 92B at the frangible web 96B. This will provide visual evidence that the gripping tab 58B has been lifted.

A fourth embodiment of the closure of the present invention is illustrated in FIGS. 8–10 to show a modification of the tamper-evident feature. The elements of the fourth embodiment of the closure that are identical or functionally analogous to those of the third embodiment discussed above with reference to FIGS. 5–7 are designated by reference numerals identical to those used for the third embodiment with the exception that the fourth embodiment reference numerals are followed by the upper case letter C.

In the embodiment illustrated in FIGS. 8–10, one end of the strap 30C is attached to the closure body portion 14C in the same manner as discussed above for the other embodiments.

At the other end of the strap 30C, a frangible tamper-evident means 90C is provided on the closure with an anchor portion 92C and a retaining member 94C.

The anchor portion 92C is substantially similar to the anchor portion 92B of the embodiment discussed above with reference to FIGS. 5–7. The anchor portion 92C is a spool-shaped annular member which has a loer flange 98C and an upper flange 100C.

As best illustrated in FIG. 10, the anchor portion 92C also includes ears 101C extending outwardly from the upper flange 100C about 180 degrees apart. The retaining member 94C is joined to these ears 101C. To this end, the retaining member 4C includes a semi-circular member 108C which has, at each end, downwardly depending legs 106C. Each leg 106C is connected via a frangible web 96C (FIG. 9) to an ear 101C on the anchor portion 92C.

As best illustrated in FIG. 9, the semicircular member 108C is normally disposed on top of, and in face-to-face contact with, the upper surface of the strap 30C. The legs 106C are disposed along either longitudinal edge of the strap 30C, and thus the retaining member 94C functions to hold the strap 30C against the top of the flange 100C of the anchor portion 92C.

When the strap 30C is lifted upwardly (by gripping the finger grip tab 58C), the retaining member 94C is broken or severed from the anchor portion 92C along the frangible webs 96C at each ear 101C. This provides visual indication that the strap 30C has been lifted away from the top of the closure.

Figure 12:
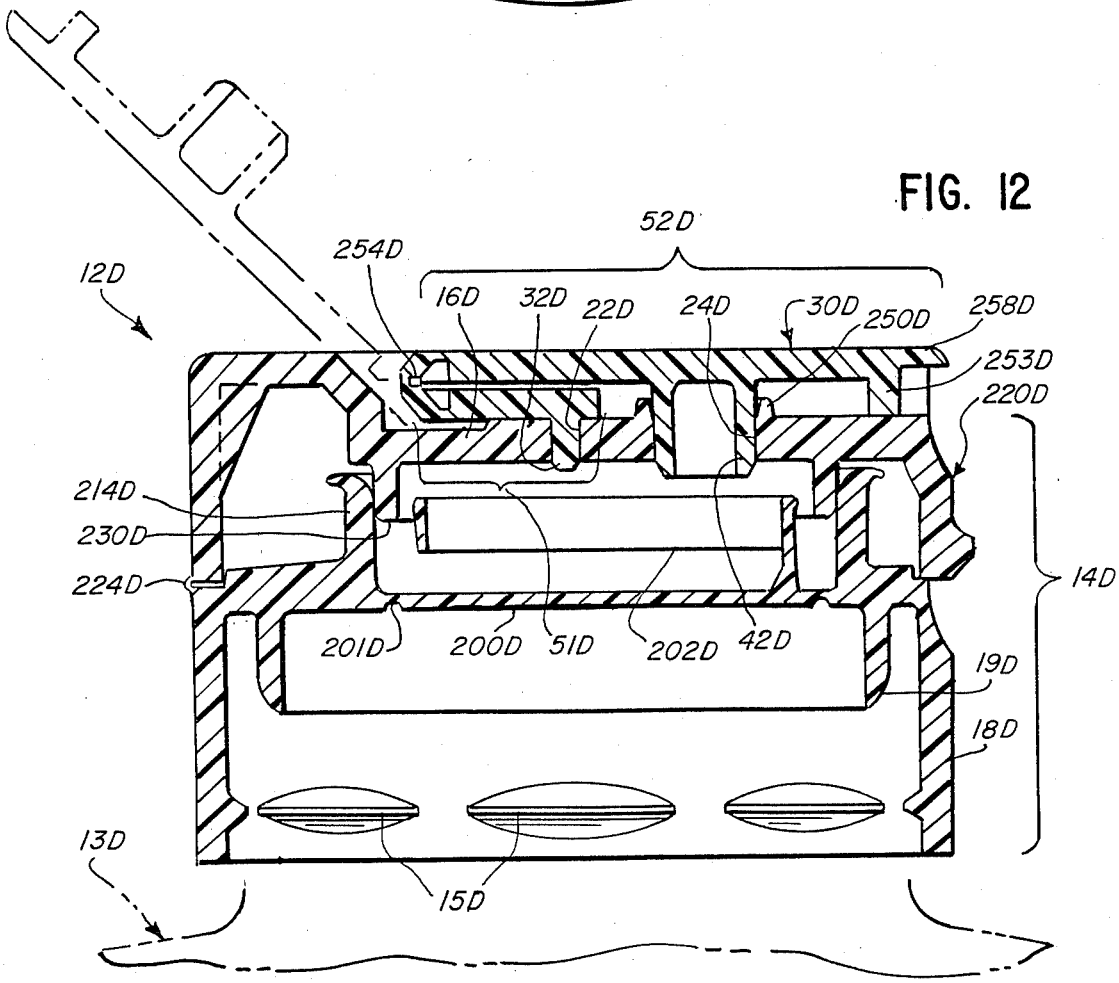
FIG. 12 is a cross-sectional view taken generally along the plane 12—12 in FIG. 11.

FIGS. 11 and 12 illustrate a fifth embodiment of the closure of the present invention which is similar to the first embodiment described above with reference to FIGS. 1–3 in that the fifth embodiment does not include a vent tube or tamper-evident feature connected directly with the closure strap. The elements of the fifth embodiment of the closure that are identical or functionally analogous to those of the first embodiment discussed above are designated by reference numerals identical to those used for the first embodiment with the exception that the fifth embodiment reference numerals are followed by the upper case letter D.

In the fifth embodiment illustrated in FIGS. 11 and 12, a closure 12D has a closure body portion 14D which has skirt 18 with snap-fit beads 15D for engaging suitable cooperating structures on the container 13D to releasably secure the closure 12D to the container 13D.

The body portion also includes an annular sealing ring 19D for engaging the inner portion of the container mouth for effecting a tight seal.

An internal tamper-evident feature is provided in the form of tear-out disc 200D defined by a reduced thickness, annular, flangible web 201D. The opening of the body portion 14D is occluded by the tear-out disc 200D which has an integrally attached pull-ring 202D. The pull-ring 202D and disc 200D are preferably integrally molded with the skirt 18D and an upwardly projecting annular discharge structure 214D which together define a lower portion of the body portion 14D.

The closure body portion 14D also includes an upper portion 220D hingedly connected to the lower portion at the top of the skirt 18D via a flexible, integrally molded hinge 224D. The upper portion 220D is adapted to close over the top of the discharge structure 214D of the lower portion of the closure body portion 14D as best illustrated in FIG. 12. To this end, the upper portion 220D is provided with an annular flange 230D for sealingly engaging the annular discharge structure 214D.

The upper portion 220D can be pulled upwardly out of engagement with the annular discharge structure 214D and pivoted about the hinge 224D to provide access to the pull-ring 202D. The pull-ring 202D can then be pulled to tear the disc 200D from the opening in the closure body portion 14D. The frangible web 201D, disc 200D and the associated pull-ring 202D may be of conventional design. Such a design is well-known in the art and further details of its construction are not herein described.

The upper portion 220D of the body portion 14D, of the closure defines a closure top wall 16D. A first hole 22D and a second hold 24D are provided in the wall 16D as best illustrated in FIG. 12. In the embodiment illustrated in FIG. 12, each hole is generally cylindrical and extends clear through the top wall 16D. The hole 24D functions as the dispensing orifice and the hole 22D serves as a means by which a novel strap 30D is anchored to the closure body portion 14D.

The strap 30D includes a first segment 51D which contains a first projection (anchor projection means) 32D and includes a second segment 52D which contains a second projection or plug 42D. In this fifth embodiment, the two segments 51D and 52D are hinged together via a conventional snap-action hinge structure 254D. The snap-action hinge structure 254D may be of a conventional design well-known to those of ordinary skill in the art, and the detailed construction of such a conventional snap-hinge structure is not herein described.

With reference to FIG. 12, it is apparent that the plug 42D is adapted to sealingly engage the opening 24D, and the projection 32D is adapted to be inserted into the opening 22D for anchoring the strap 30D to the closure top wall 16D. The strap 30D is folded over as in the first and second embodiments discussed above with respect to FIGS. 1–4. This folded over configuration necessarily results in the first segment 51D. being disposed below, and in generally vertical registry with, the second segment 52D. This accommodates the use of a conventional snap-action hinge structure 254D.

Further, this folded over configuration results in the second segment 52D being elevated somewhat above the upper surface of the closure top wall 16D. The elevation of the segment 52 accommodates an upwardly projecting annular spout structure 250D around the opening 24D. The elevation of the segment 52D above the wall 16D may be maintained at the distal end by a downwardly depending flange 253D. Adjacent the flange 253D there can be provided an extending gripping tab 258D to facilitate lifting the strap second segment 52D to open the closure.

In use, it is to be understood that the closure 12D is normally initially provided on a container 13D with the tear-out disc 200D intact. When the contents of the container 13D are to be dispensed for the first time, the closure upper portion 220D is first opened and the disc 200D is removed by pulling on the pull-ring 202D. Then the upper portion 220D is returned to the closed position and the strap segment 52D is lifted to the open position (illustrated in dashed lines in FIG. 12) to permit discharge of the container contents through the opening 24D. Of course, if it is desired to dispense the container contents at a greater rate, the container contents can be discharged through the closure with the closure upper portion 220D moved to the open position.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A dispensing closure for the mouth of a container, said closure comprising:

a body portion for being mounted to said container across the mouth of the container, said body portion having a top wall defining first and second clear-through holes; and a strap having (1) a first side surface, (2) a first projction extending from said first side surface and anchored in said first hole, (3) a second side surface, (4) a second projection extending from said second side surface and removably positioned in said second hole to seal said second hole, (5) a finger grip tab extending beyond said second projection by which said second projection can be lifted out of said second hole, (6) a first segment containing said first projection and a second segment containing both said second projection and said finger grip tab, and (7) a hinge in said strap connecting said first and second segments whereby said strap first and second segments are foldable at said hinge to postion said strap second segment on top of said strap first segment and to position said second projection in said second hole; and said first projection including a hollow vent tube extending downwardly below said closure top wall, said vent tube having a passage communicating through said first projection to the exterior of said closure top wall but being sealed closed when said strap second segment is folded on top of said strap first segment for sealing said second hole with said second projection.

2. A dispensing closure for the mouth of a container, said closure comprising:

a body portion for being mounted to said container across the mouth of the container, said body portion having a top wall defining first and second clear-through holes; and a strap having (1) a first side surface, (2) a first projection extending from said first side surface and anchored in said first hole, (3) a second side surface, (4) a second projection extending from said second side surface and removably positioned in said second hole to seal said second hole, (5) a finger grip tab extending beyond said second projection by which said second projection can be lifted out of said second hole, and (6) a first segment containing said first projection and a second segment containing both said second projection and said finger grip tab, said strap being flexible at least in a connecting region between said first and second segments whereby said strap first and second segments are foldable to position said strap second segment on top of said strap first segment and to position said second projection in said second hole; and said first projection including a hollow vent tube extending downwardly below said closure top wall, said vent tube having a passage communicating through said first projection to the exterior of said closure top wall but being sealed closed when said strap second segment is folded on top of said strap first segment for sealing said second hole with said second projection.

3. A dispensing closure for the mouth of a container, said closure comprising:

a body portion for being mounted to said container across the motuh of the container, said body portion having a top wall defining a cylindrical clear-through hole communicating with the interior of the container;

a strap connected to said closure body portion to permit movement of a length of said strap toward and away from said closure body portion, said strap having a sealing plug, said strap further having a finger grip tab extending beyond said sealing plug by which said plug can be moved toward and away from said closure body top wall; and frangible tamper-evident means anchored to said closure body portion and overlying said finger grip tab for being severed when said finger grip tab is lifted away from said closure body top wall, said tamper-evident means including:

an anchor portion connectes to said closure body portion beneath said strap, said anchor portion including a spool-shaped annular member disposed in said closure body top wall hole and defining an internal bore for functioning as a dispensing orifice for receiving said sealing plug, said annular member having a flange at each end for retaining said anchor portion in said closure body portion top wall;

a retaining member overlying said finger grip tab; and at least one frangible web connecting said anchor portion and said retaining member.

4. A dispensing closure for the mouth of a container, said closure comprising:

a body portion for being mounted to said container across the mouth of the container, said body portion having a dispensing orifice for communicating with the interior of the container;

a strap connected to said closure body portion to permit movement of a length of said strap toward and away from said closure body portion, said strap having a plug for sealing said dispensing orifice, said strap further having a finger grip tab extending beyond said plug by which said plug can be lifted out of said dispensing orifice, said finger grip tab defining a slot;

frangible tamper-evident means anchored to said closure body portion and overlying said finger grip tab for being serverd when said finger grip tab is lifted, said tamper-evident means including:

an anchor portion conneted to said closure body poriton beneath said strap;

a retaining member overlying said finger grip tab; and at least one frangible web connecting said anchor portion and said retaining member, said retaining member having (1) a first portion extending from said frangible web through said tab slot and (2) a second portion unitary with said first portion but extending parallel to, and on top of, said strap.

5. A dispensing closure for the mouth of a container, said closure comprising:

a body portion for being mounted to said container across the mouth of the container, said body portion having a top wall defining a first hole and a second hole, said second hole being a cylindrical clear through hole communicating with the interior of the container;

a strap connected to said closure body portion to permit movement of a length of said strap toward and away from said closure body portion, said strap having a first segment containing a first projection in the form of an annular wall disposed within said first hole for connecting said strap to said closure body portion, said strap having a second segment containing a sealing plug for movement toward and away from said body top wall; and frangible tamper-evident means anchored to said closure body portion and overlying a portion of said strap for being severed when said strap is lifted, said tamper-evident means including an anchor portion in the form of a spool-shaped annular member disposed in said second hole and defining an internal bore for functioning as a dispensing orifice, said spool-shaped annular member having a flange at each end for retaining said anchor portion in said top wall of said closure body portion, said tamper-evident means further including a retaining member overlying a portion fo said strap, and said tamper-evident means further including a frangible web connecting said anchor portion and said retaining member.

6. A dispensing closure for the mouth of a container, said closure comprising:

a body portion for being mounted to said container across the mouth of the container, said body portion having a top wall defining first and second clear-through holes; and a strap having (1) a first side surfacce, (2) a first projection extending from said first side surface and anchored in said first hole, (3) a second side surface, (4) a second projection extending from said second side surface and removable positioned in said second hole to seal said second hole, (5) a finger grip tab extending beyond said second projection by which said second projection can be lifted out of said second hole, (6) a first segment containing said first projection and a second segment containing both said second projection and said finger grip tab, and (7) a hinge in said strap connecting said first and second segments whereby said strap first and second segments are foldable at said hinge to position said strap second segment on top of said strap first segment and to position said second projection in said second hole of said body portion top wall.

7. A dispensing closure for the mouth of a container, said closure comprising:

a body portion for being mounted to said container across the mouth of the container, said body portion having a top wall defining anchor hole and a dispensing hole;

an elongate flexible strap having two major side surfaces, said strap defining an anchor projection means extending from one of said strap side surfaces and including an annular wall projecting from said one side of said strap and interlocked in said closure body portion through said anchor hole for anchoring said strap to said closure body portion, said anchor projection means further including a flange on the distal end of said annular wall for engaging the underside of said closure body portion top wall to retain said anhcor projection means and strap on said closure body portion, and said strap defining an openable plug means extending from the other of said strap side surfaces for entering into, and sealably occluding, said body portion dispensing hole.

8. The closure in accordance with claim 7 in which said stap has a first segment containing said anchor projection means and a second segment containing said plug means; and said strap first segment is connected to said strap second segment by a hinge in said strap whereby said strap first and second segments are foldable at said hinge to position said strap second segment on top of said first segment and to position said plug means in said dispesnsing hole.

* * * * *

UNITED STATES PATENT AND TRADEMARK OFFICE

CERTIFICATE OF CORRECTION

PATENT NO. : 4,779,766

DATED : October 25, 1988

INVENTOR(S) : John P. Kinsley

It is certified that error appears in the above-identified patent and that said Letters Patent is hereby corrected as shown below:

In the specification:

Column 3, line 51, insert --30-- after "strap";

Column 4, line 62, insert --embodiment reference numerals are followed by the upper case letter A.-- after "second";

Column 5, line 26, change "abovae" to --above--;

Column 5, line 45, change "14" to --14B--;

Column 5, line 57, delete the comma after "30B.";

Column 6, line 41, change "loer" to --lower--;

Column 6, line 47, change "4C" to --94C--;

Column 6, line 53, change "semicircular" to --semi-circular--;

Column 7, line 19, change "flangible" to --frangible--;

Column 8, line 12, change "52" to --52D--;

In the claims:

Column 9, line 38, change "motuh" to --mouth--;

Column 9, line 54, change "connectes" to --connected--;

UNITED STATES PATENT AND TRADEMARK OFFICE

CERTIFICATE OF CORRECTION

PATENT NO. : 4,779,766

DATED : October 25, 1988

INVENTOR(S) : John P. Kinsley

It is certified that error appears in the above-identified patent and that said Letters Patent is hereby corrected as shown below:

Column 10, line 56, change "fo" to --of--; and

Column 11, line 2, change "removable" to --removably--.

Signed and Sealed this

Seventh Day of March, 1989

*Attest:*

DONALD J. QUIGG

*Attesting Officer*

*Commissioner of Patents and Trademarks*